United States Patent [19]

Stubbmann

[11] 4,015,365

[45] Apr. 5, 1977

[54] CHILD'S TOY

[75] Inventor: Albert Stubbmann, Franklin Lakes, N.J.

[73] Assignee: Kohner, Inc., New York, N.Y.

[22] Filed: Aug. 29, 1975

[21] Appl. No.: 609,117

[52] U.S. Cl. ..... 46/47; 46/51; 46/91

[51] Int. Cl.[2] ..... A63H 1/32

[58] Field of Search ..... 46/1 R, 47, 51, 68, 46/91, 175 R

[56] References Cited

UNITED STATES PATENTS

| | | | |
|---|---|---|---|
| 3,039,228 | 6/1962 | Mazzadra | 46/47 |
| 3,449,858 | 6/1969 | Balleis | 46/68 |
| 3,638,350 | 2/1972 | Wiggen | 46/47 |

*Primary Examiner*—Louis G. Mancene
*Assistant Examiner*—Robert F. Cutting
*Attorney, Agent, or Firm*—Seidel, Gonda & Goldhammer

[57] ABSTRACT

Upper and lower casings, each provided with a dome and an annular portion, are fixedly coupled together. The coupling of the upper and lower casings is substantially water-tight. The upper casing is transparent. A disk is housed within the upper casing. A cut-out is securely fastened to the disk. Means for producing rotary motion of the disk and cut-out in response to movement of the upper and lower casings is suspended between the domes of the casings. One or more balls are located within the annular portions of the upper and lower casings and are freely movable therein.

18 Claims, 5 Drawing Figures

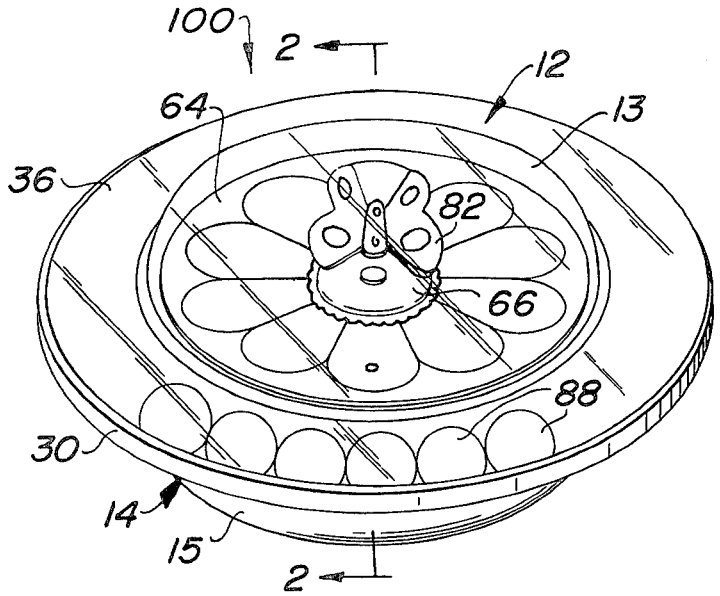
FIG. 1
FIG. 3
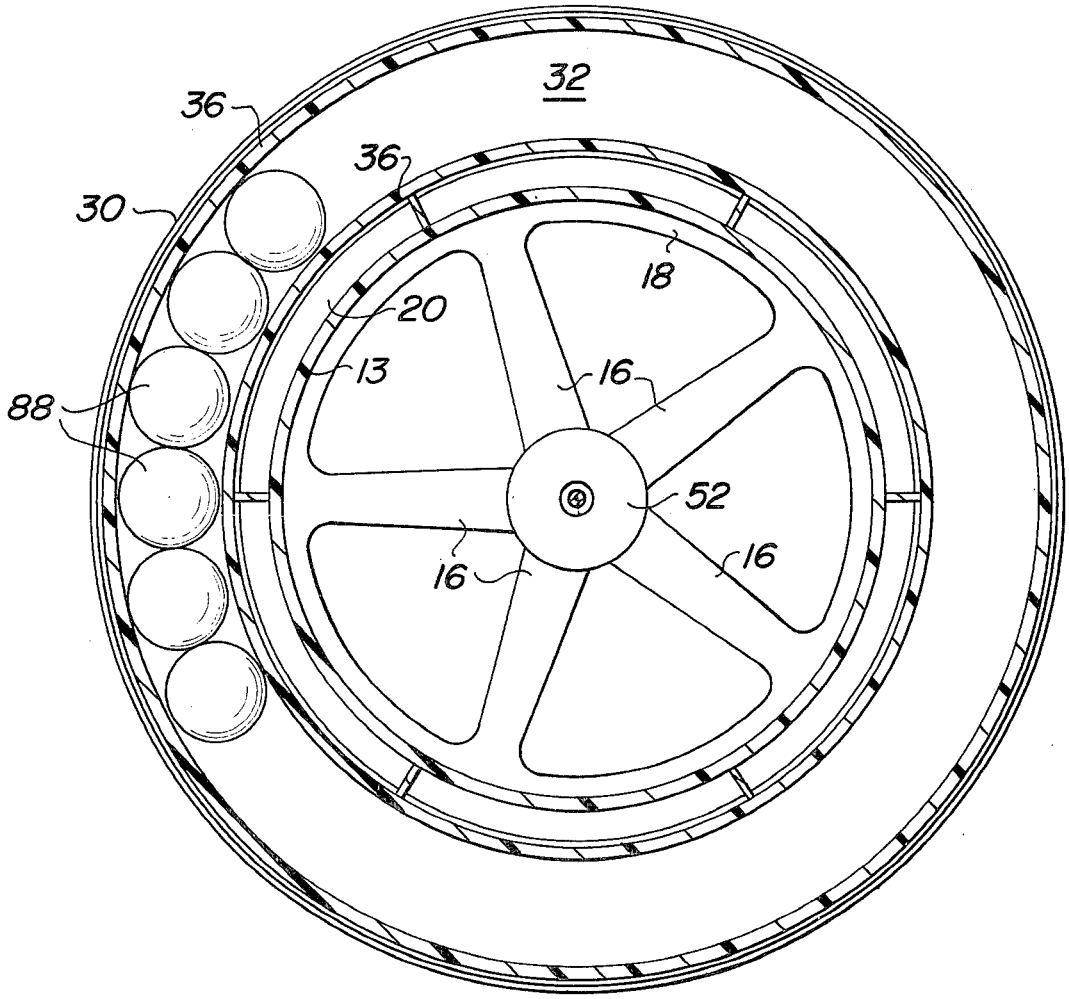

CHILD'S TOY

BACKGROUND OF THE INVENTION

The present invention relates to a child's toy. In particular, the present invention relates to a child's toy for producing visual and audible effects.

Various toys are known in the prior art for simulating the animation of a figure enclosed in a transparent ball. For example, a figure may be pivotally mounted on a pin connected at its extremities to the interior of a ball. By weighting the extremities of the figure, the figure will pivot about the axis of the pin when the ball is displaced so as to tilt the pin with respect to a horizontal plane.

Alternatively, a circular figure may be secured at its circumference to the interior of the ball along a plane bisecting the ball. Thus, the figure will not rotate independently of the ball. The figure may be weighted in which case the figure and ball are both self-righting. A bell may be connected to the figure to produce an audible sound when the figure and ball rotate.

A figure may also be positioned in an open cup-shaped base which receives the transparent bottom of a drinking vessel. The figure may be mounted on a supporting member which in turn is rotationally mounted directly on the bottom of the base. The supporting member may be weighted to enable it to rotate when the vessel and base are displaced.

In each of the above cases, the housing for the figure may not be water-tight, prohibiting use of the toy in a water environment such as a bathtub. Moreover, the visual effect provided in each instance is restricted to motion of the aforementioned figures. There are no other visual effects provided.

A principal advantage of the present invention is that a figure is rotationally displaced by the slighest touch of the child.

Another advantage of the present invention is that more than one visual effect is provided in response to the touch of the child.

A further advantage of the present invention is that an audible effect is produced simultaneously with the visual effect.

A still further advantage of the present invention is that it is substantially water-tight and can be used in a bathtub.

BRIEF SUMMARY OF THE INVENTION

Briefly, the present invention comprises a transparent upper casing, a lower casing fixedly coupled to the upper casing, a cut-out located within the upper casing, and means suspended between the upper and lower casings for producing rotational movement of the cut-out in response to movement of the casings. Each of the upper and lower casings has an annular portion, each annular portion being coupled to the other. One or more balls are located within the coupled annular portion and are freely movable therein.

BRIEF DESCRIPTION OF THE DRAWINGS

For the purpose of illustrating the invention, there are shown in the drawings forms which are presently preferred; it being understood, however, that this invention is not limited to the precise arrangements and instrumentalities shown.

FIG. 1 is a view in perspective of a child's toy constructed in accordance with the principles of the present invention.

FIG. 3 is a top plan view of the toy shown in FIG. 2 taken along the lines 3—3.

DETAILED DESCRIPTION OF THE INVENTION

Figure 2:
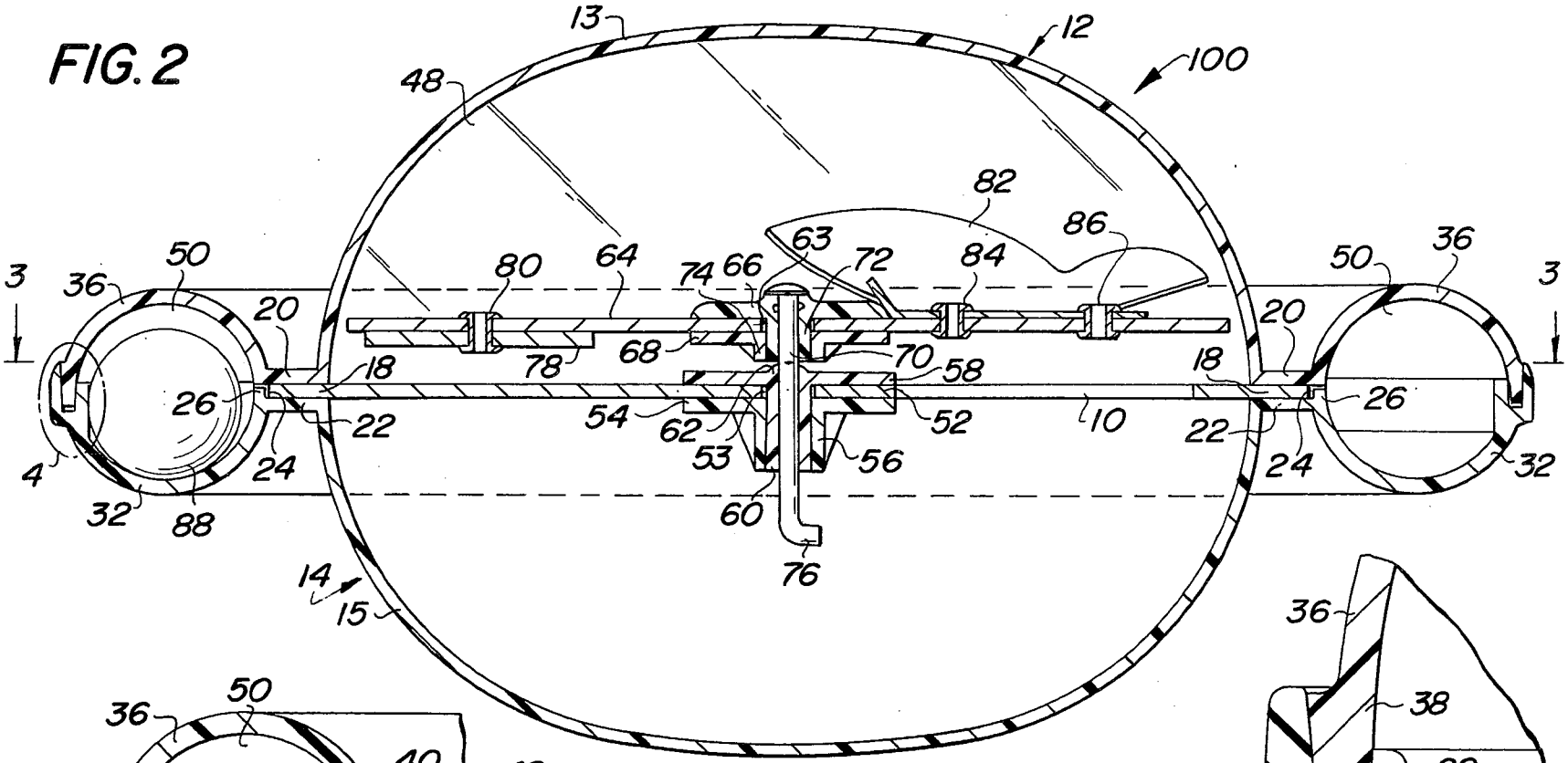
FIG. 2 is a cross-sectional view of the toy in FIG. 1 taken along the lines 2—2.

Referring to the drawings wherein like numerals indicate like elements, there is shown in FIG. 1 a child's toy 100 constructed in accordance with the principles of the present invention. An upper casing 12 is provided with a dome portion 13. A lower casing 14 is provided with a dome portion 15. In the preferred embodiment, the upper casing 12 is made of a transparent plastic material while the lower casing 14 is made of an opaque plastic material although the lower casing may also be made transparent.

A spider 10 is securely mounted between dome portions 13 and 15, FIG. 2. The spider 10 may be made of chipboard, plastic or any other suitable rigid material. The spider 10 is a skeleton-type structure which comprises arms 16 and a circular frame 18, FIG. 3. The circular frame 18 is partially enclosed by lateral annular segments 20 and 22 of upper casing 12 and lower casing 14, respectively, FIG. 2. The rim 24 of spider 10 abuts a circular lip 26 of lower casing 14. Thus, the spider 10 is locked in place between upper casing 12 and lower casing 14 and has the appearance of being suspended therebetween.

Figure 4:
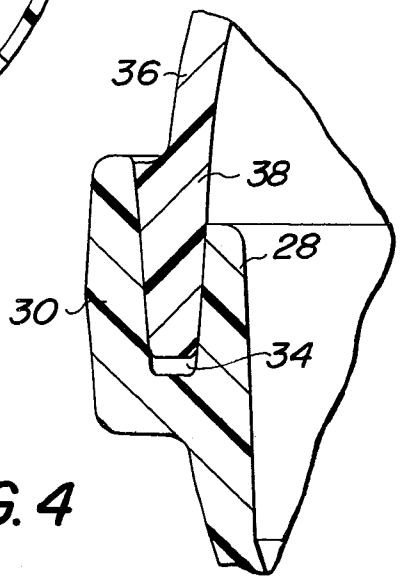
FIG. 4 is an enlarged view of the portion of the toy shown in FIG. 2 and enclosed within the dashed ellipse 4.

Lower casing 14 is provided with an annular portion 32, having a hemispherical cross-section, FIG. 2. Annular portion 32 extends in an annular region about the dome portion 15 of lower casing 14. The annular portion 32 is provided with an inner circular wall 28 and a flanged outer circular wall 30 which define a circular gap 34, FIG. 4.

The upper casing 12 is provided with an annular portion 36 having a hemispherical cross-section, FIG. 2. Annular portion 36 extends in an annular region about dome portion 13 of upper casing 12. The annular portion 36 of upper casing 12 includes a circular edge 38 which is flanged outwardly to fit within circular gap 34. More specifically, circular edge 38 is frictionally engaged by inner circular wall 28 and outer circular wall 30 of the lower casing 14. Thus, the upper casing 12 and lower casing 14 are frictionally coupled to each other and are substantially water-tight.

Figure 5:
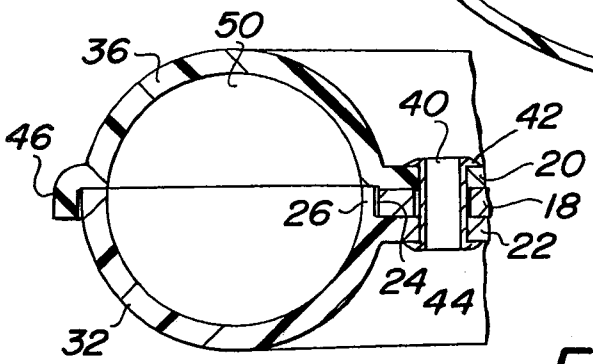
FIG. 5 is a partial cross-sectional view of an alternative embodiment of the present invention.

In an alternative embodiment of the invention, the upper casing 12 and lower casing 14 are coupled to each other by means of a plurality of rivets 40 at the lateral annular segments 20 and 22 of the upper and lower casings 12 and 14, respectively, FIG. 5. In this embodiment, circular frame 18 of spider 10 is sandwiched between lateral annular segments 20 and 22. The rivet 40 extends through the composite structure of lateral annular segments 20 and 22 and the circular frame 18. Rivet 40 clamps the composite structure together by means of heads 42 and 44. The annular portion 36 of upper casing 12 is provided with a flanged circular lip 46 which abuts the exterior of annular portion 32 of lower casing 14. In both the embodiments shown in FIGS. 2 and 5, the upper and lower casings 12 and 14 are securely engaged and form substantially water-tight interiors 48 and 50.

Spider 10 is provided with a hub 52 having an opening 53, FIGS. 2 and 3. A circular washer 54 having a sleeve 56 is fastened to the underside of hub 52. A circular washer 58 having a stem 60 and hub 62, FIG. 2, is fastened to the topside of hub 52. Stem 60 of washer 68 extends through the opening 53 in hub 52 and fits securely within the sleeve 56 of washer 54.

Disk 64 is rotatably mounted on spider 10 by means of circular washers 66 and 68 and post 70. Circular washer 66 is fastened to the topside of disk 64 and is provided with a stem 72 which extends downwardly through opening 63 in disk 64. Circular washer 68 is fastened to the underside of disk 64 and is provided with a sleeve 74. The stem 72 of washer 66 is securely engaged by sleeve 74 of washer 68. Post 70 extends through washers 66, 68, 58 and 54 and terminates in a curved portion 76 beneath the spider 10. In particular, the post 70 extends a predetermined length below the stem 60 of washer 58, FIG. 2. The post 70 is rotatably engaged by stem 60 of washer 58. Thus, post 70 can rotate about the central axis of stem 60.

A weight 78 is fastened to the underside of disk 64 by means of rivet 80. Weight 78 may be a steel washer or any other suitable element for causing the rotation described hereinafter. A paper cut-out 82 in the form of a butterfly or other fanciful figure is secured to the topside of disk 64 by means of rivets 84 and 86. The weight 78 is substantially heavier than the paper cut-out resulting in a net imbalance in the distribution of weight on the disk 64. Accordingly, if toy 100 is tilted about an axis transverse to the post 70 so as to displace weight 78 upwardly, the disk 64 will rotate. More specifically, the weight 78 will seek a lowermost position of equilibrium much like a pendulum. Consequently, the disk 64 will rotate towards the equilibrium position and oscillate about the position until equilibrium is reached.

One or more balls 88 are housed in the interior 50 of annular portions 36 and 32. The balls 88 are free to travel within the interior 50 upon tilting or other displacement of toy 100. As the balls 88 roll along the inside walls of annular portions 36 and 32 they produce a rattling noise. Thus, the tilting or other displacement of toy 100 results in the simultaneous movement of the disk 64 and the balls 88. The visual effect of the moving paper cut-out 82 and the moving balls 88 is augmented by the rattling sound produced by the balls against the inside walls of annular portions of 36 and 32. A child, therefore, can gauge very clearly the results of displacing toy 100 by these visual and audible effects.

The construction of the toy 100, as already described, has no loose parts accessible to the child and is water-tight. Accordingly, the toy 100 can be used in a wide variety of environments. For instance, the toy may be used as a source of amusement in a playpen or a bath. In the bath, the toy 100 will float and the paper cut-out 82 and balls 88 will move in response to the touch of the child or the displacement of the water. In addition, in the preferred embodiment described herein, the casings 12 and 14 are made of a plastic material so that the toy 100 is unbreakable.

Preferably, the disk 64 is brightly colored with a scallopped pattern to resemble the petals of a flower, and the cut-out 82 is in the form of a butterfly. At rest, the brightly colored disk 64 and butterfly cut-out 82 lie in a substantially horizontal plane. The weight 78 is hidden from view. Both the cut-out 82 and the weight 78 are positioned eccentrically on disk 64. In the preferred embodiment herein, the cut-out 82 and weight 78 are located opposite each other on a diameter of disk 64. The natural tendency of a child will be to reach out and touch the butterfly cut-out 82. The dome portion 13 of upper casing 12 will prevent the child from touching the cut-out and, due to the child's touch, the toy 100 will be tilted so that the cut-out is displaced downwardly and the weight is displaced upwardly. Accordingly, the disk 64, including the flower design and cut-out 82, will rotate to re-align the cut-out above the weight. At the same time, the balls 88 will roll downwardly. Thus, each time the child attempts to touch the disk or cut-out, it will appear to elude the child's grasp, presenting both a baffling challenge and source of amusement for the child. Also, the balls 88 will roll and clatter within the interior 50, providing further visual and audible sources of interest for the child.

The present invention may be embodied in other specific forms without departing from the spirit or essential attributes thereof and, accordingly, reference should be made to the appended claims, rather than to the foregoing specification as indicating the scope of the invention.

I claim:

1. A child's toy comprising:
   - a transparent upper casing provided with a dome portion and an annular portion separated therefrom by a lateral annular segment;
   - a lower casing provided with a dome portion and an annular portion separated therefrom by a lateral annular segment, said lower casing being fixedly coupled to said upper casing, said coupled upper and lower casings being substantially watertight;
   - a disc disposed within said dome of said upper casing;
   - means suspended between said domes of said upper and lower casings for rotatably supporting said disc; and
   - means for producing rotary motion of said disc in response to movement of said upper and lower casings.

2. A toy according to claim 1, wherein said upper and lower casings are frictionally coupled along the annular portions thereof.

3. A toy according to claim 1, wherein said upper lower casings are riveted together along said lateral segments.

4. A toy according to claim 1, including one or more balls located within said annular portions of said upper and lower casings and freely movable therein and a cut-out securely fastened to said disk.

5. A toy according to claim 1, wherein said lower casing is opaque.

6. A toy according to claim 1, wherein said upper and lower casings are made of a plastic material.

7. A toy according to claim 1, wherein said means for producing rotary motion comprises a weight fastened to said disc and eccentrically positioned thereon, and wherein said means for rotatably supporting said disc comprises a spider having a hub and a plurality of arms extending radially outward therefrom ending in a frame, said frame fitting securely between said upper and lower casing lateral annular segments and means for rotatably mounting said disc on said spider hub.

8. A toy according to claim 7, wherein said means for rotatably mounting said disk on said spider comprises a post securely fastened to said disk and rotatably mounted on said spider.

9. A toy according to claim 7, including a cut-out fastened to said disk.

10. A child's toy, comprising:

a transparent upper casing;

a lower casing fixedly coupled to said upper casing, said coupled upper and lower casings being substantially watertight;

a disc disposed within said upper and lower casings;

a cut-out mounted on said disc;

means suspended between said upper and lower casings for rotatably supporting said disc; and means for producing rotational movement of said disc in response to movement of said upper and lower casings.

11. A toy according to claim 10, wherein each of said upper and lower casings has an annular portion and one annular portion is coupled to the other, and said toy further includes one or more balls which are located within said coupled annular portions and which are freely movable therein.

12. A toy according to claim 10, wherein said upper and lower casings are frictionally coupled.

13. A toy according to claim 10, wherein said upper and lower casings are riveted together.

14. A toy according to claim 10, wherein said coupling of said upper and lower casings is substantially water-tight.

15. A toy according to claim 10, wherein said means for producing rotational movement of said disc includes a weight securely fastened to said disk and eccentrically positioned thereon.

16. A toy according to claim 10, wherein said lower casing is opaque and said upper and lower casings are made of plastic material.

17. A child's toy, comprising:

a lower casing and a transparent upper casing;

said lower casing fixedly coupled to said upper casing at their peripheries, said coupled upper and lower casings being substantially water-tight;

a cut-out located within said upper casing; and means suspended between said upper and lower casings for producing rotational movement of said cut-out in a plane within said upper casing in response to non-rotational movement of said upper and lower casings.

18. A toy according to claim 17, including means for producing reciprocating movement of said cut-out in a plane perpendicular to the plane of rotation of said cut-out in response to movement of said upper and lower casings.

* * * * *